US006595757B2

(12) United States Patent
Shen

(10) Patent No.: US 6,595,757 B2
(45) Date of Patent: Jul. 22, 2003

(54) AIR COMPRESSOR CONTROL SYSTEM

(76) Inventor: Kuei-Hsien Shen, 2/F., No. 108, Hsintai 5th Rd., Sec. 1, Hsichih City, Taipei County (TW)

( * ) Notice: Subject to any disclaimer, the term of this patent is extended or adjusted under 35 U.S.C. 154(b) by 4 days.

(21) Appl. No.: 09/993,475

(22) Filed: Nov. 27, 2001

(65) Prior Publication Data

US 2003/0099549 A1 May 29, 2003

(51) Int. Cl.[7] ..... F04B 49/06

(52) U.S. Cl. ..... 417/44.2; 417/44.1; 417/44.11; 137/115.25

(58) Field of Search ..... 417/44.2, 44.1, 417/26, 307, 271, 23, 44.11; 137/115.25

(56) References Cited

U.S. PATENT DOCUMENTS 4,345,442 A * 8/1982 Dorman ..... 62/160
5,086,266 A * 2/1992 Shiga et al. ..... 322/28
5,733,017 A * 3/1998 Nakashima et al. ..... 303/10
5,947,693 A * 9/1999 Yang ..... 417/45
5,980,211 A * 11/1999 Tojo et al. ..... 417/45
6,414,462 B2 * 7/2002 Chong ..... 318/701
6,501,240 B2 * 12/2002 Ueda et al. ..... 318/135
2001/0028236 A1 * 10/2001 Cheong ..... 318/701
2002/0064461 A1 * 5/2002 Yoo et al. ..... 417/44.1
2002/0093327 A1 * 7/2002 Yoo et al. ..... 324/76.52
2002/0149342 A1 * 10/2002 Nakata et al. ..... 318/801

* cited by examiner

*Primary Examiner*—Charles G. Freay
*Assistant Examiner*—William H. Rodriguez
(74) *Attorney, Agent, or Firm*—Rosenberg, Klein & Lee

(57) ABSTRACT

An air compressor control system is constructed to include a motor, an accumulation tank, a pump, a pressure switch, a pressure control valve, and a micro-controller. When the pressure of the accumulation tank surpassed a predetermined high level, the pressure switch is off, thereby causing the micro-controller to open the pressure control valve for relieving forced air pressure and then to turn off the motor. When the pressure of the accumulation tank dropped below the predetermined low level, the pressure switch is switched on, thereby causing the micro-controller to provide power supply to the motor again and then to close the air pressure control valve for enabling forced air to be pumped into the accumulation tank by the pump after the motor has been fully started.

1 Claim, 3 Drawing Sheets

AIR COMPRESSOR CONTROL SYSTEM

BACKGROUND OF THE INVENTION

The present invention relates to an air compressor and, more particularly, to an air compressor control system, which controls pumping action subject to the air pressure status of the accumulation tank, and prevents a big starting current when starting the motor.

Conventional air compressor control systems include two types, namely, the power-interruption type air compressor control system and the uninterrupted type air compressor control system. The power-interruption type air compressor control system, as shown in FIG. 1, comprises a motor M, a pump P, an accumulation tank 1, a circuit breaker (or relay) 2 connected between the motor M and AC power supply, and a pressure switch 3 connected between the accumulation tank 1 and the circuit breaker 2. When the air pressure of the accumulation tank 1 dropped below the predetermined low level, the pressure switch 3 switches on the circuit breaker 2 to start the motor M, thereby causing the pump P to pump forced air into the accumulation tank 1. On the contrary, when the air pressure of the accumulation tank 1 surpassed the predetermined high level, the pressure switch 3 switches off the circuit breaker 2 to stop the motor M, and therefore the pump P is off. This design of power-interruption type air compressor control system has numerous drawbacks as outlined hereinafter:

1. When starting the motor M, a big starting current is produced, which may cause the circuit to trip off or to be burned out.
2. During normal running, power supply is constantly provided to the motor M, i.e., the supply of electricity to the motor M does not vary with the condition of the load. Therefore, this design of power-interruption type air compressor control system does not provide a power saving function.
3. Due to the aforesaid two problems, this design of power-interruption type air compressor control system is suitable for a small scale of air compressor only.

The uninterrupted type air compressor control system, as shown in FIG. 2, comprises a motor M, a pump P, an accumulation tank 1, and a relief valve 4 connected in parallel to the circuit between the pump P and the accumulation tank 1. The relief valve 4 is opened when the pressure of the accumulation tank 1 surpassed the predetermined high level, or closed when the pressure of the accumulation tank 1 dropped below the predetermined low level. When electrically connected to start the motor M, the pump P pumps forced air into the accumulation tank 1. When the pressure of the accumulation tank 1 surpassed the predetermined high level, the relief valve 4 is opened to relieve forced air, and at this time the motor M and the pump P keep running. This design of uninterrupted type air compressor control system has drawbacks as follows:

1. Because the motor M and the pump P keep running when relieving forced air, the motor M and the pump P keep consuming electricity, and much electric energy is wasted. Therefore, this design of uninterrupted type air compressor control system is suitable for high air consumption and high frequency of pumping, but not suitable for low air consumption and low frequency of pumping.
2. Because the motor M and the pump P keep running when relieving forced air, the operational cost of the system is high.
3. Because the motor M and the pump P keep running when relieving forced air, the motor M and the pump P wear quickly with use.

SUMMARY OF THE INVENTION

The present invention has been accomplished to provide an air compressor control system, which eliminates the aforesaid drawbacks. It is one object of the present invention to provide an air compressor control system, which saves consumption of electric energy. It is another object of the present invention to provide an air compressor control system, which extends the service life of the motor and the pump. It is still another object of the present invention to provide an air compressor control system, which prevents the occurrence of a big starting current when starting the motor. To achieve these and other objects of the present invention, the air compressor control system comprises a motor, an accumulation tank, a pump, a pressure switch, a pressure control valve, and a micro-controller. The micro-controller is comprised of a CPU (central processing unit), a chopping circuit, a current phase detection circuit, and a voltage phase detection circuit When the pressure of the accumulation tank surpassed a predetermined high level, the pressure switch is off, thereby causing the micro-controller to open the pressure control valve for relieving forced air pressure and then to turn off the motor. When the pressure of the accumulation tank dropped below the predetermined low level, the pressure switch is switched on, thereby causing the micro-controller to provide power supply to the motor again and then to close the air pressure control valve for enabling forced air to be pumped into the accumulation tank by the pump after the motor has been fully started.

DETAILED DESCRIPTION OF THE PREFERRED EMBODIMENT

Figure 1:
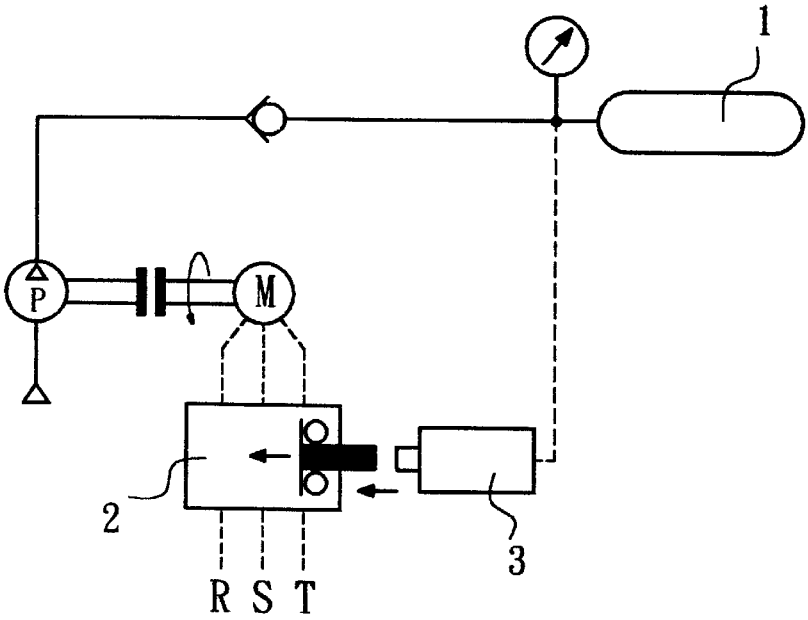
FIG.1 PRIOR ART
FIG. 1 is a system block diagram of a power-interruption type air compressor control system according to the prior art.
Figure 2:
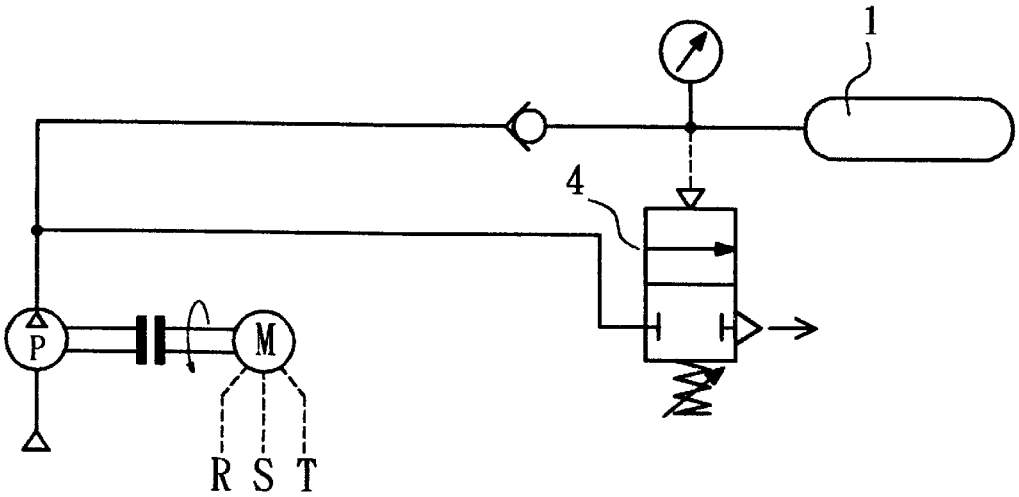
FIG.2 PRIOR ART
FIG. 2 is a system block diagram of an uninterrupted type air compressor control system according to the prior art.
Figure 3:
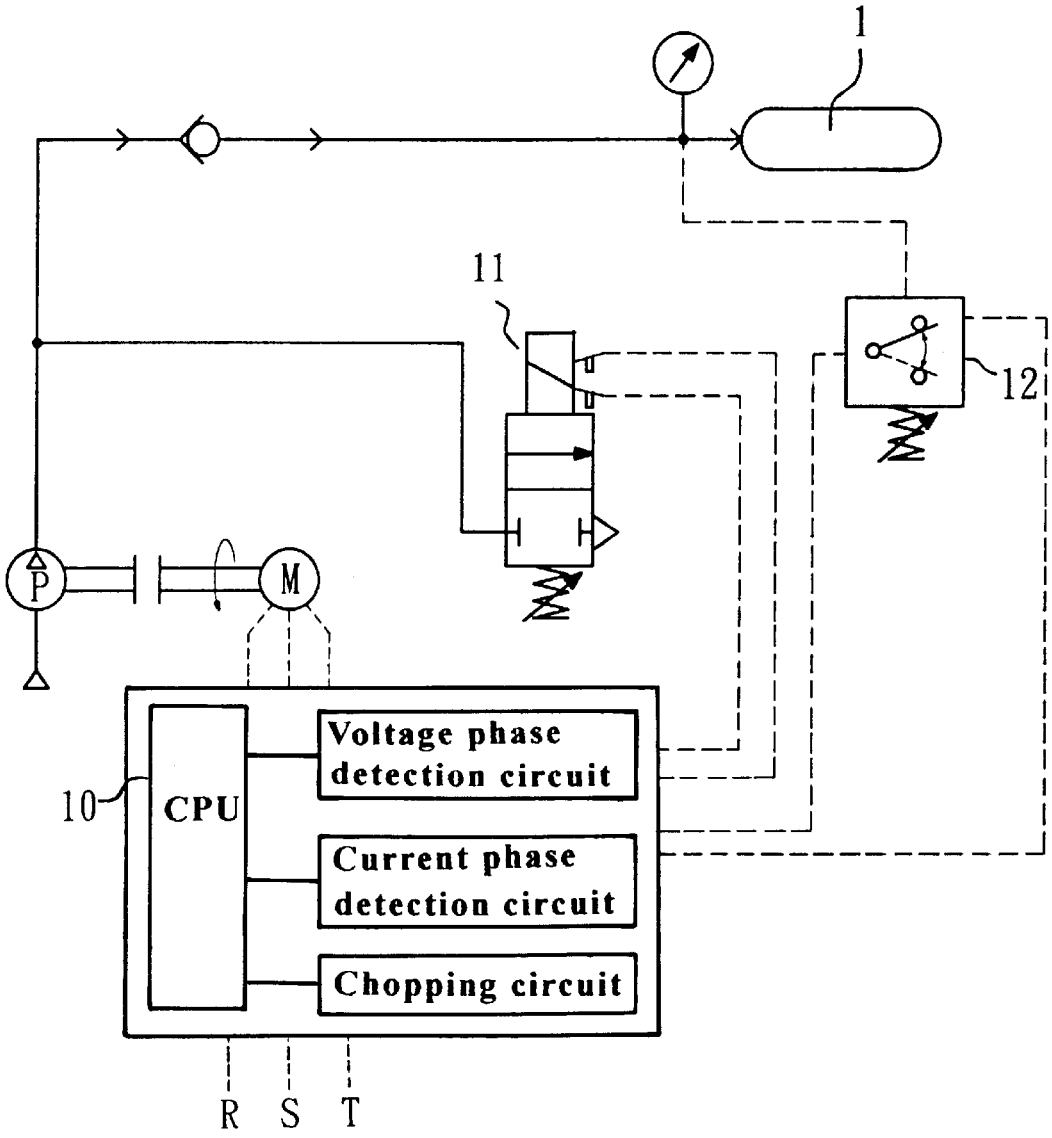
FIG. 3 is a system block diagram of an air compressor Control system according to the.present invention.

Referring to FIG. 3, an air compressor is shown comprising a motor M, a pump P, an accumulation tank 1, an air pressure control valve 11, and a pressure switch 12. A micro-controller 10 is connected between the motor M and an AC power source. The micro-controller 10 is adapted for receiving a status signal from the pressure switch 12 and controlling the operation of the motor M and the air pressure control valve 11 subject to the status signal from the pressure switch 12. The micro-controller 10 comprises a CPU (central processing unit), a chopper circuit, a current phase detection circuit, and a voltage phase detection circuit. The CPU determines the phase difference between the current phase detected by the current phase detection circuit and the voltage phase detected by the voltage phase detection circuit for determining the degree of the load. The CPU further controls the chopper circuit to chop power supply subject to the degree of the load (the phase difference between the current phase and the voltage phase), i.e., to pass only that portion of the power supply's periodic waveform beyond a triggering angle within a given cycle of that waveform. Preferably, the set program determines the triggering angle in an inversely proportional manner with respect to the load. The smaller the load is, the greater the triggering angle and the power saving rate will be.

At an initial stage of the supply of power supply to the air compressor, the air pressure control valve 11 is controlled by the micro-controller 10 to relieve air pressure (the mode of relief of load), preventing the pump P from pumping forced air into the accumulation tank 1. After the motor M has been fully started, the air pressure control valve 11 is controlled to stop relieving air pressure, for enabling the pump P to pump forced air into the accumulation tank 1 (the mode of up-loading). When the air pressure of the accumulation tank 1 has reached the predetermined high level, the pressure switch 12 is switched off, providing an off signal to the micro-controller 10, thereby causing the micro-controller 10 to open the air pressure control valve 11, preventing the pump P from pumping forced air into the accumulation tank 1, and then to stop the motor M.

The pressure switch 12 is "on" during normal functioning of the air compressor to pump forced air into the accumulation tank 1, and feeds back the "on" signal to the micro-controller 10. When the air pressure of the accumulation tank 1 reached the predetermined high level, the pressure switch 12 is switched from "on" position to "off" position, providing the "off" signal to the micro-controller 10, thereby causing the micro-controller 10 to open the air pressure control valve 11 for relieving air pressure and then to cut off power supply from the motor M. When the air pressure of the accumulation tank 1 dropped below the predetermined low level, the pressure switch 12 is switched on, thereby causing the micro-controller 10 to provide power supply to the motor M again. At the initial stage, the air pressure control valve 11 is maintained opened to relieve air (Forced air is not pumped into the accumulation tank 1). After the motor M has been fully started, the air pressure control valve 11 is closed, enabling forced air to be pumped into the accumulation tank 1 (the mode of up-loading).

Figure 4:
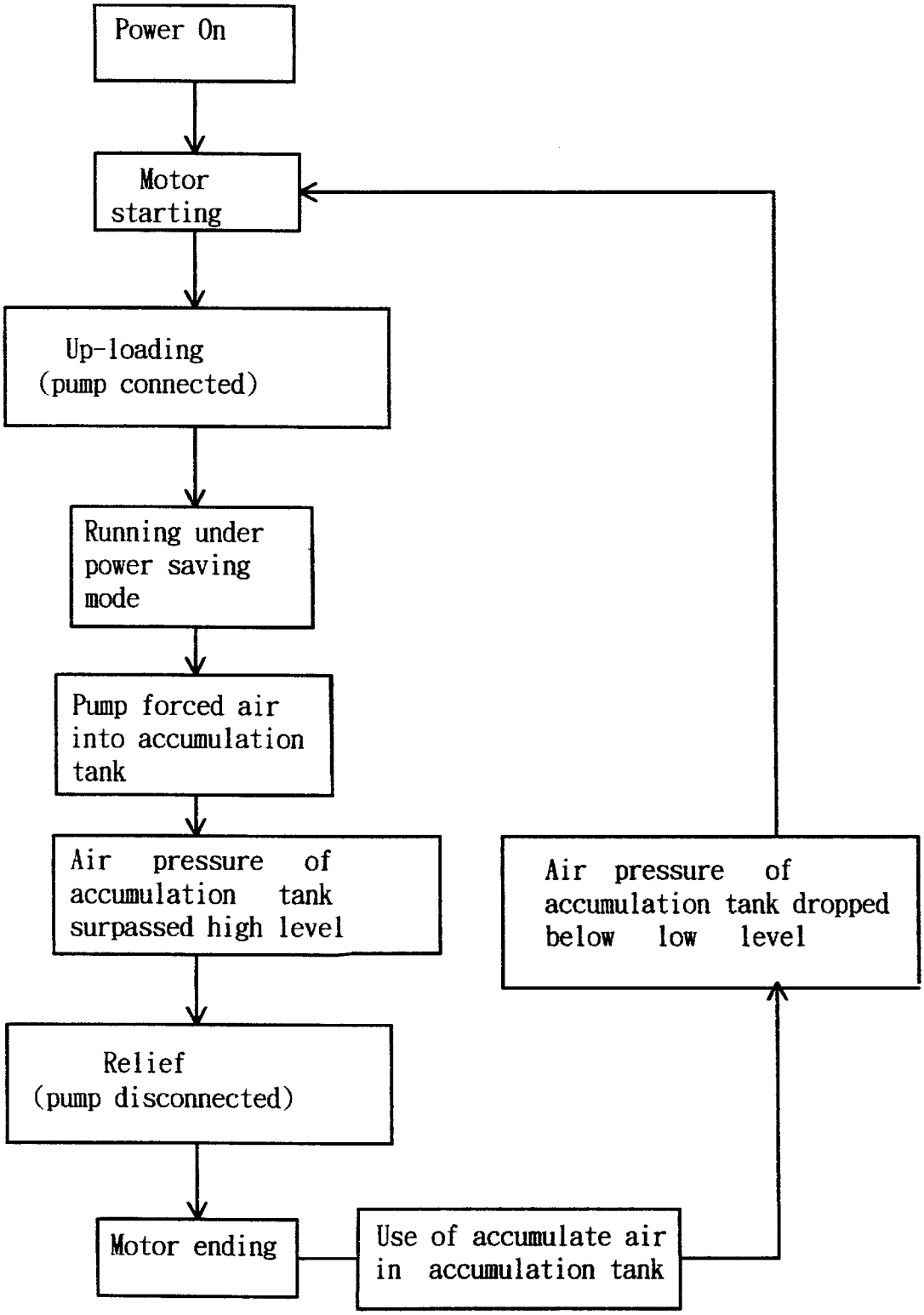
FIG. 4 is a control flow chart of the present invention.

The use and effect of the present invention are outlined hereinafter with reference to FIG. 4.

1. Start:

The invention provides "soft start" function. The so-called "soft start" is to rotate the motor at a low speed at the initial stage and then to accelerate the revolving speed of the motor. If the motor is started rapidly at the initial stage, a high torsional resisting force will be produced, resulting in "big current", i.e., "big starting current". The "soft start" prevents the occurrence of big starting current.

2. Up-loading:

This is the unique design of the present invention. At the initial starting stage, the air pressure control valve 11 is opened to relieve air pressure, preventing forced air from passing to the accumulation tank 1, therefore the pump P runs idle and the motor M does not bear any load at this stage, i.e., the motor M can easily be started. When the motor M fully started to achieve "inertia rotation", the micro-controller 10 detects the current status, and then closes the air pressure control valve 11, for enabling the pump P to pump forced air into the accumulation tank 1, i.e., the pump P works to achieve the function of "up-loading". Therefore, at the initial starting stage, the motor M is started smoothly without load, preventing the occurrence of a big current.

3. Normal Running of Air Pumping Status:

After the aforesaid starting and up-loading actions, it enters "normal running of air pumping status" to pump forced air into, the accumulation tank 1. At this time, there is a power saving control, i.e., the micro-controller 10 achieves a chopping action subject to the degree of the load. The micro-controller 10 controls the degree of the power supply triggering angle subject to the degree of the load (the chopping, triggering angle control actions are achieved by means of the operation of an alternating silicon controlled semiconductor (this is of the known art, not within the scope of the invention), i.e., before outputting R, S, T phase current to the motor M, it is chopped into smaller current and lower voltage. According to the formula of P (real power)=V (voltage)×I (current)×PF (power factor). When I (current) reduced and voltage (V) dropped, increasing PF (power factor) reduces P (real power) to achieve power saving. Further, power saving rate is subject to the power supply waveform chopping degree. The greater the chopping degree is, the greater the power saving rate will be. On the contrary, the smaller the chopping degree is, the smaller the power saving rate will be. The program set in the CPU of the micro-controller 10 controls the power saving function.

4. Relief of Load, Stop Running:

When the air pressure of the accumulation tank 1 reached the predetermined high level, the pressure switch 12 is off, thereby causing the micro-controller 10 to outputs a control signal to open the air pressure control valve 11 for relieving forced air from the pump P. At this time, the pump P runs idle, and the motor M bears no load. Thereafter, the micro-controller 10 outputs a control signal to stop the motor M. On the contrary, when the air pressure of the accumulation tank 1 dropped below the predetermined low level, the micro-controller 10 returns to the aforesaid procedures of "Start", "Up-loading", and "Normal running of air pumping status".

According to the aforesaid design, the motor M is not constantly maintained running. It runs only when pumping is required. When pumping is not required, the motor M is off. When starting the motor M, the invention eliminates the occurrence of big starting current.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An air compressor control system comprising a motor, an accumulation tank, a pump driven by said motor to pump forced air into said accumulation tank, a pressure switch connected to said accumulation tank, a pressure switch connected to said accumulation tank and adapted for detecting the air pressure of said accumulation tank, and a pressure control valve connected between said accumulation tank and said pump and adapted for relieving forced air from said pump, wherein a micro-controller is connected between said motor and an AC power supply and adapted for receiving a signal from said pressure switch and controlling operation of said pressure control valve and said motor subject to the position of said pressure switch, said micro-controller comprising a CPU, a chopping circuit, a current phase detection circuit, and a voltage phase detection circuit, said CPU detdermining a phase difference between a current phase detected by said current phase detection circuit and a voltage phase detected by said voltage phase detection circuit for determining the degree of the load acted at said pump, said CPU controlling said chopper circuit to chop AC power supply subject to the degree of the load for enabling a program set therein to determine a triggering angle in an inversely proportional manner with respect to the load; at an initial stage of the supply of power supply to the air compressor, said micro-controller controlling said air pressure control valve to relieve air pressure, preventing said pump from pumping forced air into said accumulation tank, and then closing said air pressure control valve to stop relieving air pressure after said motor has been fully started, for enabling said pump to pump forced air into said accumulation tank; when the air pressure of said accumulation tank reaches a predetermined high level, said pressure switch being switched to an "off" position, providing an "off" signal to said micro-controller, thereby causing said micro-controller to open said air pressure control valve, preventing said pump from pumping forced air into said accumulation tank, and then stopping said motor; said pressure switch being switched to an "on" position during normal functioning of the air compressor to pump forced air into said accumulation tank, and feeding back an "on" signal to said micro-controller; when the air pressure of said accumulation tank reaches the predetermined high level, said pressure switch being switched from the "on" position to the "off" position, providing the "off" signal to said micro-controller, thereby causing said micro-controller to open said air pressure control valve for relieving air pressure and then cutting off power supply from said motor; when the air pressure of said accumulation tank drops below the predetermined low level, said pressure switch being switched to the "on" position, thereby causing said micro-controller to provide power supply to said motor again; said air pressure control valve being maintained opened to relieve forced air from said pump at the initial stage when starting said motor, and said air pressure control valve being closed for enabling forced air to be pumped into said accumulation tank by said pump after said motor has been fully started.

* * * * *